United States Patent [19]

Okinaka et al.

[11] 4,437,948

[45] Mar. 20, 1984

[54] COPPER PLATING PROCEDURE

[75] Inventors: Yutaka Okinaka, Madison; Craig G. Smith, North Plainfield; Lawrence E. Smith, Plainfield, all of N.J.

[73] Assignee: Bell Telephone Laboratories, Incorporated, Murray Hill, N.J.

[21] Appl. No.: 312,266

[22] Filed: Oct. 16, 1981

[51] Int. Cl.[3] ..... C25D 3/38

[52] U.S. Cl. ..... 204/52 R; 204/290 R; 204/290 F

[58] Field of Search ..... 204/52 R, 52 Y, 44, 204/106, 107, 108, 123, 290 R, 290 F

[56] References Cited

U.S. PATENT DOCUMENTS

| | | | |
|---|---|---|---|
| 3,428,544 | 2/1969 | Bianchi et al. | 204/290 |
| 3,491,014 | 1/1970 | Bianchi et al. | 204/242 |
| 3,616,445 | 10/1971 | Bianchi et al. | 204/290 |
| 3,632,498 | 1/1972 | Beer | 204/290 |
| 3,711,385 | 1/1973 | Beer | 204/59 |
| 3,775,268 | 11/1973 | Fino et al. | 204/52 R |
| 3,846,273 | 11/1974 | Bianchi et al. | 204/290 |
| 4,067,783 | 1/1978 | Okinaka et al. | 204/43 |
| 4,269,670 | 5/1981 | Smith | 204/15 |
| 4,310,391 | 1/1982 | Okinaka et al. | 204/46 G |

OTHER PUBLICATIONS

Journal of Applied Electrochemistry, vol. 1, 1971, pp. 231–243, "Fundamental and Applied Aspects of the Electrochemistry of Chlorine".

*Primary Examiner*—G. L. Kaplan

*Attorney, Agent, or Firm*—Walter G. Nilsen

[57] ABSTRACT

A process is described for the electrodepositon of copper on various surfaces. The process involves use of a nonconsumable counterelectrode. Of particular significance is the composition of the surface of the counterelectrode. The surface of the counterelectrode comprises iridium oxide and tantalum oxide. Such processes can be carried out at high speeds, with smaller and more efficient equipment and can use various copper compounds as a source of copper.

11 Claims, 3 Drawing Figures

COPPER PLATING PROCEDURE

TECHNICAL FIELD

The invention involves a process for electroplating copper using a nonconsumable counterelectrode.

BACKGROUND OF THE INVENTION

Many manufacturing processes involve the electroplating of copper on various surfaces including metal and conducting surfaces. Such copper platings are used to prevent corrosion, to increase electrical conductivity or thermal conductivity and to serve as an adherent layer for additional metallic layers. Recently, much activity with regard to copper electroplating has been associated with the production of various electronic circuits and devices including circuit boards, integrated circuits, electrical contact surfaces, etc.

Traditional electroplating processes for copper involve the use of a consumable counterelectrodes (or anodes). Here, the counterelectrode is made of metallic copper which is oxidized to soluble copper ions during the electroplating process. The counterelectrodes serve not only as the anode in the electroplating process but also as a source of copper ions in the electroplating bath to replace the copper ions consumed in the electroplating process at the cathode.

The copper electroplating process described in the instant application involves use of nonconsumable counterelectrode. Such processes are advantageous because of potentially higher plating rates, better control of bath chemistry, smaller plating apparatus size and use of various copper salts (such as copper oxide) as sources of copper in the electroplating process. These copper salts are often readily available from etching procedures in the manufacture of various electronic circuit boards.

Particularly important in electroplating processes with nonconsumable anodes is the structure and surface composition of the anode. The nature of the anode often determines (or at least greatly influences) the efficiency of the process, the nature of side reactions at the anode, the nature of the resulting deposit and the lifetime of the plating bath.

The composition of electrodes for various electrochemical processes have been described extensively in the literature. Particular references are as follows: U.S. Pat. Nos. 3,428,544 (Guiseppe Bianchi et al, issued Feb. 18, 1969); 3,491,014 (Guiseppe Bianchi et al, issued Jan. 20, 1970); 3,616,445 (Guiseppe Bianchi, issued Oct. 26, 1971); and Extended Abstracts of the Electrochemical Society Spring Meeting, Seattle, Washington, May 21–26, 1978, Volume 78-1, pp. 1202–1205. In addition, two patents by H. B. Beer (U.S. Pat. No. 3,632,498 issued on Jan. 4, 1972 and 3,711,385 issued on Jan. 16, 1973) are of interest. Also, several references are of interest in connection with anodes used for gold plating. These are U.S. Pat. Nos. 4,067,783 issued on Jan. 10, 1978 to Okinaka et al; 4,269,670 issued to C. G. Smith on May 26, 1981, and a patent application with inventors Y. Okinaka and C. G. Smith, filed Dec. 21, 1979 with Ser. No. 105,977 and now U.S. Pat. No. 4,310,391.

SUMMARY OF THE INVENTION

The invention is a copper electroplating process employing nonconsumable anode or counterelectrode in which said anodes are at least partially covered with a substance including active oxide. The substance may include essentially inert material for use as a matrix, binder or to increase surface area, etc. The active oxide comprises from 20 to 90 mole percent oxide of iridium remainder oxide of tantalum. It is believed that much of the beneficial effects of this invention including long electrode life and electrode stability results from the formation of mixed oxide of iridium and tantalum such as $Ir(TaO_3)_4$. Such anodes exhibit long life, permit high copper plating rates, yield excellent copper deposits and exhibit a minimum of undesirable side reactions. The anodes are made by a variety of procedures including wetting the anode surface with a soluble form of the iridium and tantalum and heat treating in air to convert to the oxide. The temperature of the heat treatment may vary over large limits but 400 to 600 degrees C. (450 to 550) is most preferred because it maximizes electrode lifetimes and stability.

DETAILED DESCRIPTION

Figure 1:
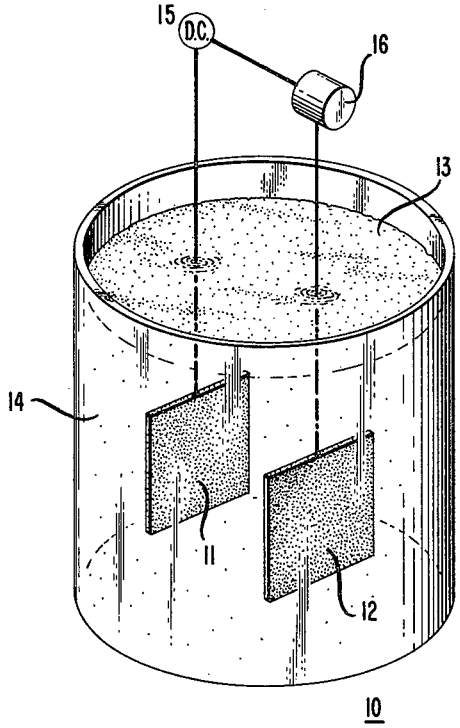
FIG. 1 shows a typical apparatus for carrying out a copper electroplating process, including nonconsumable anode and cathode.

In broad terms, the invention is based on the observation that certain iridium-tantalum anodes prepared under certain conditions (particularly as to the temperature of the heat treatment) have two important advantages in copper plating. First, the anode potential for the oxidation of water is much lower than with conventional insoluble electrodes and for some electrodes this advantage extends to quite high current densities. Second, the stability and lifetime of these electrodes are much higher than with conventional electrodes. Stability here refers to stable electrochemical properties of the electrode including constant anode voltage at a given current density, particularly at high current densities.

Although the advantages of the invention extend over wide ranges of current densities including low current densities (1–50 $mA/cm^2$), commercially high current densities (50–1000 $mA/cm^2$ or higher) are of greatest importance since it permits high plating rates with anode of reasonable size.

A significant aspect of the invention is that small amounts of lead in the bath solution increases electrode stability and decreases anode potential. Generally, the lead is present in the chemicals (particularly copper compounds) used in the composition of the bath. Experiments such as scanning electron microscopy analysis of the electrodes indicate that a porous film of lead dioxide is formed on the anode. It is preferred that in the electroplating process that a small amount of lead species (soluble lead salt in the range from 2–20 parts per million, 5–10 parts per million most preferred) be present in at least the initial bath composition and optionally in subsequent replenishments of the bath. Various other structures may also be used including pressing a substance together into a body used as the anode. The substance should include the active oxide in which at least part is the oxide of iridium and oxide of tanalum.

Also included might be various inert materials such as metals or alloys to increase conductivity, binders to facilitate pressing into a solid body or to aid in adhering the active oxide to the electrode body.

The electrode is made up of a substrate and a surface coating of metal oxide. The substrate may be any substance that is compatible with the copper plating process. It should be chemically inert to the plating bath and sufficiently conductive to pass the current used in the plating process. Generally, the substrate is metallic. Typical substrates are made of titanium, niobium or tantalum or alloys of these metals. Particularly convenient is titanium or an alloy of niobium and tantalum.

The surface of the electrode is at least partly covered with a mixture of metal oxides. This mixture of oxides comprises the oxides of two metals, namely iridium and tantalum. Evidence appears to indicate that mixed oxides such as $Ir(TaO_3)_4$ are present as well as one or more individual oxides (i.e., $IrO_2$ or $Ta_2O_5$). At least 10 mole percent of the mixed oxide should be present for best results. Particularly good results are obtained where the mixed oxide is present in amounts exceeding 50 or even 80 mole percent.

Composition of the mixture of oxides may vary over wide limits and still provide useful results. Good results are obtained where the mole percent of iridium in the form of oxide is from 20 to 90. Below 20 mole percent, the electrochemical potential for the electrolysis of water begins to rise; above 90 mole percent, the stability and lifetime of the electrode might become reduced. In addition, iridium is much more expensive than tantalum and it is economically desirable to reduce iridium content without sacrificing electrode stability, lifetime or desirable properties. Best results are obtained with the iridium between 60 and 90 mole percent. Most preferred is the range between 70 and 80 mole percent iridium. This range is based primarily on maximum electrode lifetime and stability. These preferred ranges yield maximum advantage for high plating rates where the current density at the anode exceeds 50 or even 100 $mA/cm^2$. It is believed that the tantalum not only acts as binders, but also enhances the catalytic activity of the iridium compounds. Although the reason for this is not known, a possible explanation is that there is some kind of cooperative action (i.e., chemical reaction, compound formations, etc.) between the two kinds of oxides. Generally, extensive mixing together of the two kinds of oxides is preferred.

At low current densities (i.e., below 50 $ma/cm^2$), much less iridium is required to produce the desired result (low anode potential and long lifetime). Preferred compositions are 20–45 mole percent iridium, remainder tantalum. Indeed, some of the iridium may be replaced by other (less expensive) metals such as cobalt and nickel. Up to 70 mole percent of the iridium may be replaced in this way. This is advantageous because it greatly reduces the cost of the electrode. Generally, using such an electrode increases slightly the electrochemical potential for the electrolysis of water. Where the current density is not extremely high (say, 1–50 $mA/cm^2$) this is not likely to be disadvantageous. Also, in some copper electroplating baths, (for example, where concentration of trivalent gold is not critical), slightly increased electrochemical potential is not disadvantageous.

In addition, for low current densities, additional oxides (usually in the form of binder oxides) can be introduced to the active oxide coating without adverse affects. Typical binder oxides are beryllium, calcium, strontium, barium, scandium, yttrium, lanthanum and the rare earth elements with atomic numbers 58–71. Barium is most preferred because of availability and stability of the electrode. Up to 80 mole percent of the active oxide may be binder metal oxide.

The electrodes may be produced by a variety of procedures. For example, the individual oxides can be made up, mixed together and glued to a substrate. The procedure described below is convenient and yields highly homogeneous mixtures of oxides. In addition, adherence to the substrate is extremely good which increases the lifetime of the electrode.

The procedure may be described in general terms as follows:

A solution is made of an iridium compound and a tantalum compound using a mole ratio of iridium to tantalum desired in the active oxide. The electrode substrate is dipped in this solution or painted with this solution. Successive layers are built up by drying or heat treating the electrode between dipping or painting on successive layers. Best results are obtained by heat treating the electrode between dippings or painting operations. Generally, best results are obtained if the electrode is heat treated after each two dippings or four paintings. The heat treatment involves heating the electrode to between 400 and 600 degrees C. (500 degrees C. preferred) in air or other oxygen-containing atmosphere for 15–30 minutes. It is believed that this procedure converts much of the soluble forms of iridium and tantalum into oxide so that more layers can be built up on the electrode. A final baking operation is carried out at a temperature of 400 to 600 degrees C. for at least 15 minutes to 10 hours. Preferred temperature range is 450 to 550 degrees C. and preferred times are from one to two hours. These conditions ensure complete conversion to the oxide without excess oxidation of the substrate or excessive use of time. The preferred temperature range yields highest lifetimes and stability for the electrodes.

Rapid heating to the temperature range of the thermal treatment is preferred. Specifically, it is preferred that the electrode being thermally treated be heated (from room temperature) to the temperature range of thermal treatment within 5 minutes. This can be done in a variety of ways. For example, a preheated metal block (aluminum or copper block) may be used as a heat source to ensure rapid heating.

A detailed procedure for the preparation of the anode is given below. In this procedure, a titanium substrate is used and the metal oxides are tantalum oxide and iridium oxide.

First, the substrate surface is prepared so as to remove foreign matter and oxides from the surface. This generally is done by dry honing the substrate surface.

Second, a coating solution is prepared as follows: A solution of iridium compound is prepared in a solvent which dissolves both iridium and tantalum compounds. Then a solution of a tantalum compound is prepared in a solvent which dissolves both the tantalum compound and iridium compound. The two solutions are mixed together in a proportion desired for the electrode coating.

A specific procedure for preparation of the coating solution might be useful in understanding the invention. The volume of solution required depends on the area of electrode to be covered. Best results are obtained with a volume of 0.083 ml/sq cm of electrode area to be covered. The final solution is made in two parts so that one half of the volume is required for each part.

For convenience, an iridium solution and a tantalum solution are made up with equal molar concentrations. Typically, the iridium solution is made up by dissolving 2.10 gms of $IrCl_3$ $3H_2O$ in 100 ml of concentrated HCl (2.4 molar aqueous hydrochloric acid). Usually, the acid solution is heated to about 70 degrees C. to facilitate dissolving the iridium compound. Iridium tetrachloride may also be used. This procedure yields a 0.06 molar solution. After the iridium tetrachloride is dissolved, the solution is allowed to cool.

The solution of tantalum compound is conveniently made by dissolving tantalum pentachloride in methanol. The tantalum pentachloride should be added slowly to prevent splattering and the solution stirred rapidly. In this procedure, 2.15 gms of $TaCl_5$ are dissolved in 100 ml of electronic grade methanol. This yields a solution with a concentration of 0.06 molar tantalum. The two solutions are mixed together to form the final solution applied to the electrode. Since the molar concentrations of the iridium and tantalum solutions are the same, the relative volumes determine the relative molar concentrations. For example, to make a 100 ml solution with 80 mole percent iridium, 20 mole percent tantalum, 80 ml of iridium solution are mixed with 20 ml of tantalum solution.

It is preferred that the solutions are prepared immediately before the coating procedure. The solutions are mixed together and cooled. The container holding the solution should be covered to prevent evaporation of the methanol.

Immediately before applying the coating, the surface of the substrate is etched with acid (preferably hydrochloric acid for fifteen minutes) and then dried. The substrate is then exposed to or soaked in the solution of metal compounds prepared above. The soaking may be done in a number of ways including painting with a brush or dipping into the solution. The electrode surface is then dried generally in a hood to provide adequate ventilation. A heat gun or other source of heat may be used. It is preferred that drying be reasonably slow, say at least one minute. This soaking and drying procedure is repeated a number of times to ensure a reasonably thick coating of metal oxides. Generally, with dipping the procedure is repeated twice; with painting the procedure is repeated four times. The substrate is then baked for a short time (5 to 30 minutes) at approximately 500 degrees C. and then cooled rapidly to room temperature. A cold metal block may be used to affect rapid cooling.

This procedure may be repeated a number of times in order to build up the thickness of the metal oxide mixture on the surface of the electrode. After sufficient thickness is obtained, the electrode is baked in air for approximately one to two hours at 500 degrees C.

Compositions of the copper bath are for the most part conventional. The bath generally contains a source of copper (typically $CuSO_4$) and an electrolyte (typically sulfuric acid). Compositions generally range from 0.05 to 1.2 molar $CuSO_4$ and 0.1 to 2 molar sulfuric acid. For baths with high throwing power, the molar concentration of sulfuric acid should be at least 5 times the molar concentration of copper ions. As stated above, small amounts of lead are also preferred. Various additives may be present to improve plating quality and the electroplating process.

FIG. 1 shows a typical gold plating apparatus 10 useful for copper plating small items and as an experimental setup for testing various parts (i.e., plating solution, electrode, etc.) of copper plating apparatus. The plating apparatus 10 is made up of anode or counterelectrode 11 made in accordance with the invention, and cathode 12 on which the copper is electroplated. Also shown is the plating bath 13 and container 14 for the plating bath. There is an electric power source 15 for the electroplating process and a current limiting apparatus 16 (generally a variable resistor) to control the plating process.

Figure 2:
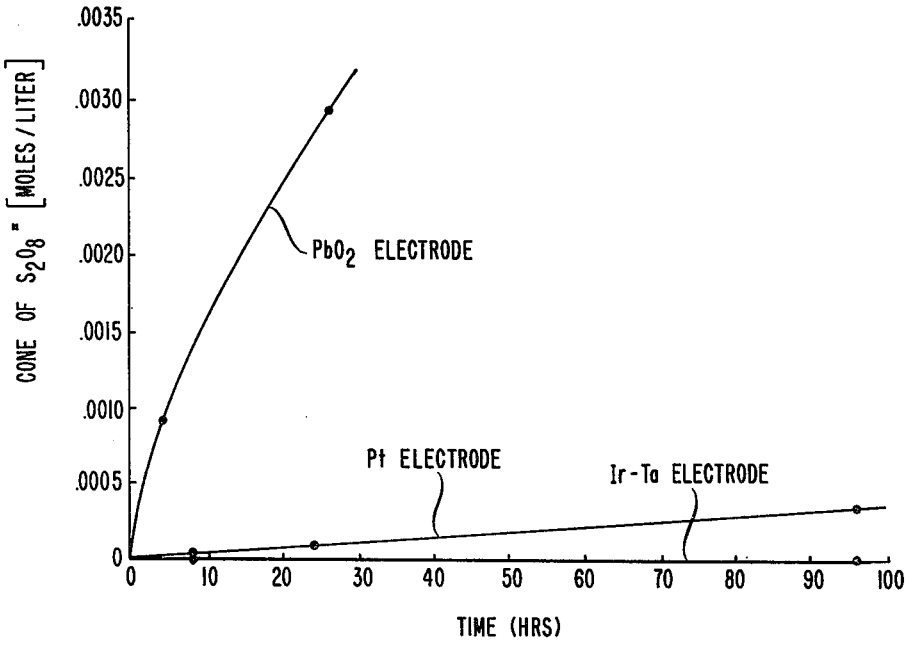
FIG. 2 shows a plot of persulfate formation as a function of plating time for several electrodes including an iridium-tantalum electrode.

A particular advantage of anodes exhibiting low anode potential is reduced side reactions which might limit the lifetime of the copper plating bath. In many copper plating baths the only anion subject to oxidation is the sulfate ion. This anion is oxidized to the persulfate ion, $S_2O_8^{-2}$. FIG. 2 shows the results of some experiments using different types of anodes. The concentration of persulfate ion is plotted against time of electrode deposition using an anode current density of 200 amperes per square foot. The area of the anode was four square centimeters and the electrolyte was 16 percent sulfuric acid. In the lead dioxide anode persulfate ion is formed quite rapidly but with a platinum anode the rate of formation of persulfate ion is considerably reduced. Best results are obtained with an iridium-tantalum anode in which 80 mole percent of the active oxide is iridium oxide. Here there is almost no measurable formation of persulfate ion, even where electrodeposition is carried out at high current densities. There are several disadvantages to the formation of persulfate ion. It etches the copper surface being plated and decreases the cathodic current efficiency of the electrodeposition process. Excessive formation of persulfate ion requires frequent changing of the plating bath or chemical treatment of the plating bath to remove the persulfate ion.

Figure 3:
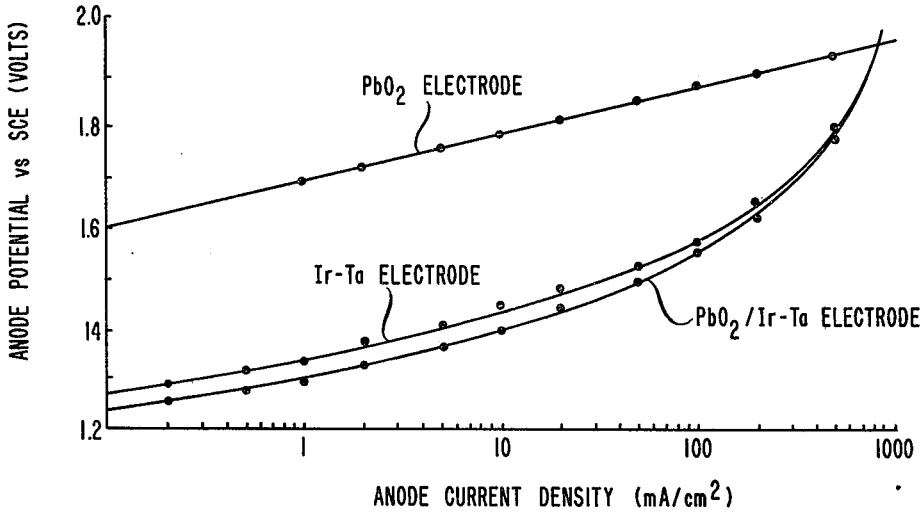
FIG. 3 shows a plot of polarization voltage as a function of current density for several electrodes including an iridium-tantalum electrode.

FIG. 3 shows another advantage of the inventive process. Here the anode potential on a Saturated Calomel Electrode scale is plotted as a function of anode current density. For a lead dioxide anode the potential is greater than about 1.7 volts even at a low current density of 1 $mA/cm^2$. In contrast the potential for the iridium-tantalum electrode is considerably lower even at quite high current densities. Also, the introduction of a small amount of lead into the plating bath which presumably partially coats the anode with lead dioxide further reduces the anode potential. Reduced anode potential not only leads to a more efficient electrodeposition process as far as energy is concerned but also minimizes oxidation of various ions and substances in the plating bath. Such oxidation often limits the lifetime of the bath and requires further additions of chemicals either to replenish oxidized material (i.e., organic additives) or chemicals to remove undesirable oxidation products in the bath.

What is claimed is:

1. A process for electroplating copper including the step of passing current through an anode, electroplating bath and cathode with a given current density at the surface of the anode characterized in that the surface of the anode consists of active oxide, said active oxide consisting of oxide of two metals, iridium and tantalum in which the composition of the oxide of two metals range from 20 to 90 mole percent iridium, remainder tantalum.

2. The process of claim 1 in which the oxide of two metals consists essentially of 60 to 90 mole percent iridium, remainder tantalum.

3. The process of claim 2 in which the active oxide is a coating and the oxide of two metals consists essentially of 70 to 80 mole percent iridium, remainder tantalum.

4. The process of claim 1 in which the current density at the anode varies between 50 and 1000 $mA/cm^2$.

5. The process of claim 1 in which the initial electroplating bath composition comprises 2 to 20 parts per million lead.

6. The process of claim 5 in which the oxide of two metals comprises 20–45 mole percent iridium, remainder tantalum and the current density at the anode is from 1–50 $mA/cm^2$.

7. The process of claim 1 in which the active oxide comprises a mixed oxide of iridium and tantalum.

8. The process of claim 6 in which the mixed oxide of iridium and tantalum has the nominal formula $Ir(TaO_3)_4$.

9. The process of claim 8 in which the mixed oxide of iridium and tantalum comprises at least 10 mole percent of the active oxide.

10. The process of claim 8 in which the oxide of two metals comprises 20–45 mole percent iridium, remainder tantalum and the current density at the anode is from 1–50 $mA/cm^2$.

11. The process of claim 1 in which the active oxide of the two metals comprises 20–45 mole percent iridium, remainder tantalum and the current density at the anode is from 1–50 $mA/cm^2$.

* * * * *